US005257811A

United States Patent [19]

Biba

[11] Patent Number: 5,257,811

[45] Date of Patent: Nov. 2, 1993

[54] VERTICAL LOUVER SYSTEM

[75] Inventor: Scott I. Biba, Mazomanie, Wis.

[73] Assignee: Springs Window Fashions Division, Inc., Middleton, Wis.

[21] Appl. No.: 983,036

[22] Filed: Nov. 30, 1992

[51] Int. Cl.[5] ..... E06B 9/30

[52] U.S. Cl. ..... 160/168.1; 160/178.1

[58] Field of Search ..... 160/168.1, 178.1, 236, 160/166.1, 176.1, 177, 900, 172, 173, 178.3

[56] References Cited

U.S. PATENT DOCUMENTS 3,106,240 10/1963 Weber ..... 160/168.1
3,125,154 3/1964 Woodle ..... 160/178.1
4,291,738 9/1981 Grenga et al. ..... 160/176.1
4,356,855 11/1982 Holzer ..... 160/236 X
5,123,471 6/1992 Ford ..... 160/168.1

*Primary Examiner*—David M. Purol
*Attorney, Agent, or Firm*—Vernon J. Pillote

[57] ABSTRACT

A vertical louver suspension system for louvers of the type in which the center of gravity of the cross-sectional contour of the louver is offset from one side of the louver and which enables such louvers to hang vertically. An adapter body is attached to each louver adjacent the upper end and provides a hanger engaging member adjacent the center of gravity of the louver cross-sectional contour for suspending the louver from the hanger substantially at the center of gravity of the louver cross-sectional contour.

9 Claims, 1 Drawing Sheet

FIG. 1
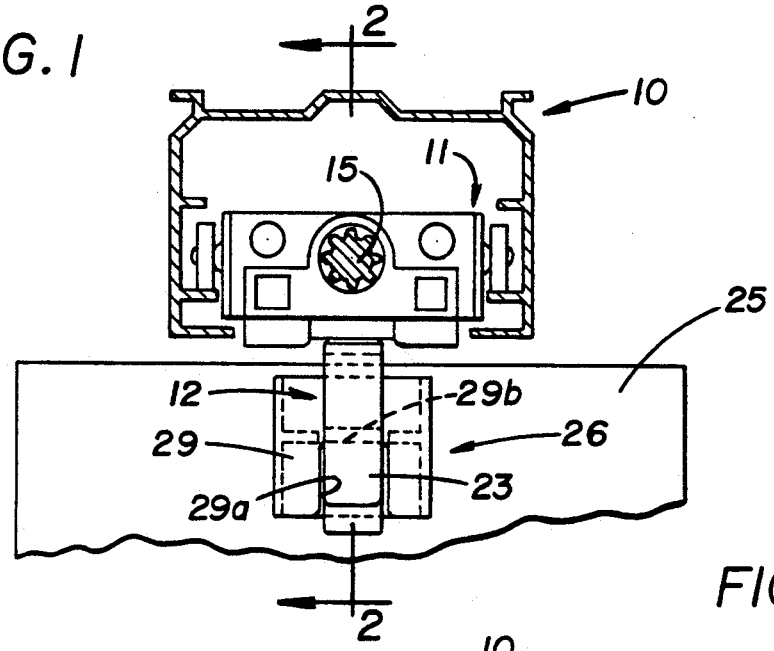
FIG. 2
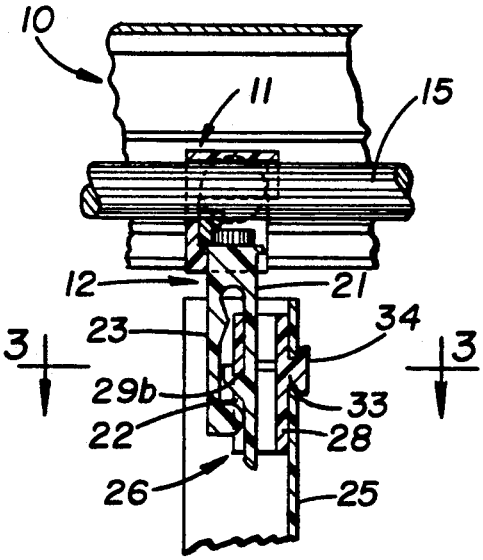
FIG. 4
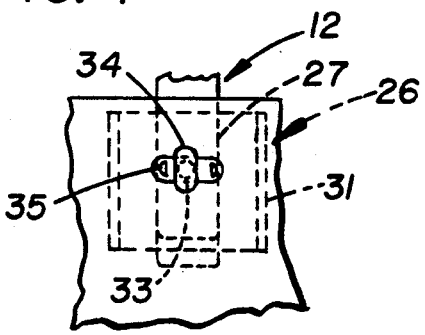
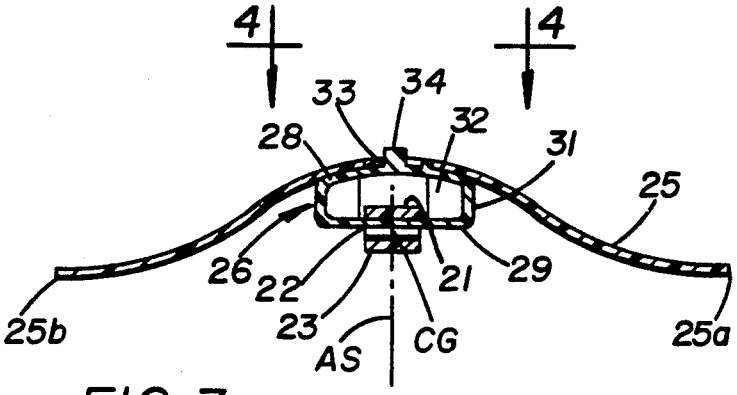
FIG. 3
FIG. 5
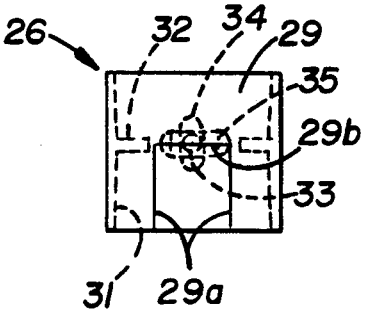

VERTICAL LOUVER SYSTEM

BACKGROUND OF THE INVENTION

The present invention relates to vertical louver systems of the type having a track and a plurality of louver carriers mounted for movement along the track and louver hangers mounted on the carriers for turning about a generally upright axis. It is common practice to provide louvers having a straight or substantially straight cross-section and when such louvers are suspended from the louver hangers, the louvers depend vertically from the hangers. However, some louvers used in vertical louver systems have non-linear cross-sectional contour and, if the non-linear cross-sectional contour is such that the center of gravity of the louver cross-sectional contour is at a point spaced from one side of the louver, the louver will not depend vertically downwardly but will instead extend downwardly at an angle to the vertical, which angle varies with the spacing of the center of gravity of the louver cross-sectional contour from the side of the louver and also with the length of the louver. Louvers which do not hang vertically not only adversely affect the overall appearance of the vertical louver system, but can also adversely affect the operation of the louver system.

SUMMARY OF THE INVENTION

It is an object of the present invention to overcome the above problem with the prior art by providing an improved louver suspension system for louvers of the type having the center of gravity of the cross-sectional contour of the louver offset from one side of the louver which enables such louvers to hang vertically.

Accordingly, the present invention provides a vertical louver system including a track having a plurality of louver carriers movable along the track and louver hangers mounted on the carriers for turning about a generally upright axis, and a plurality of elongated louvers each having a non-linear cross-sectional contour such that the center of gravity of the cross-sectional contour is at a point spaced from one side of the louver, and an adapter body attached to each louver adjacent an upper end thereof and having hanger engaging means adjacent the center of gravity point for suspending the louver from the hangers substantially at the center of gravity of the louver cross-sectional contour.

BRIEF DESCRIPTION OF THE DRAWINGS

FIG. 1 is a transverse sectional view through a vertical louver system embodying the present invention;

FIG. 2 is a fragmentary longitudinal sectional view taken on the plane 2—2 of FIG. 1;

FIG. 3 is a horizontal sectional view taken on the plane 3—3 of FIG. 2;

FIG. 4 is a view taken on the plane 4—4 of FIG. 3; and

FIG. 5 is a fragmentary rear view of the adapter body for suspending a louver.

DETAILED DESCRIPTION

The vertical louver system in general includes an elongated horizontal track 10 having a plurality of carriages 11 mounted for movement along the track and louver hangers 12 mounted on the carriers for turning movement about a generally upright axis. As is conventional, traverse means (not shown) are provided for moving the carriages along the track between a blind closed position and blind open position with means for controlling spacing between the carriages when they are in a closed position. Means are also provided for rotating the hangers about a generally upright axis and, in the embodiment illustrated, the rotating means includes a spined shaft 15 that extends lengthwise of the track and meshes with gearing in each of the carriages for turning the hangers about an upright axis in response to turning of the shaft 15. Means for traversing carriages and rotating the slat hanger is well known in the art and detailed description is deemed unnecessary.

The hangers 12 are preferably of a type commonly used for directly supporting vertical louvers. As best shown in FIG. 2, the hangers 12 include a downwardly extending leg 21 having an upwardly opening hook portion 22 at one side, and a second downwardly extending leg 23 that extends alongside the hook portion 22. When the louvers are of a type in which the center of gravity of the cross-sectional contour is disposed in the louver or very closely adjacent the louver, the louvers can be suspended directly on the hangers 21 and the louvers will depend substantially vertically downwardly from the hangers. However, if the center of gravity of the louver cross-sectional contour is spaced from one side of the louver, the louver will, if suspended directly on the hanger 12, depend from the hanger at an angle to the vertical.

The louver 25 shown in cross-section in FIG. 3 has a non-linear cross-sectional contour with a center of gravity designated CG that is spaced from one side of the louver. As shown in FIG. 4, the louver has an oblong opening 27 located substantially medially between opposite side edges **25*a*, 25*b* of the louver. If this louver is supported directly on the hanger 21 with the hook portion 22 extending through the opening 27**, the louver would be urged by gravity so as to depend from the hanger at an angle to the vertical which angle increases as the louver length is decreased.

In accordance with the present invention, a rigid adapter body 26 is attached to the louver adjacent the upper end and the adapter body is formed with hanger engaging means adjacent the center of gravity of the louver cross-sectional contour to suspend the louver from the hanger substantially at the center of gravity of the louver cross-sectional contour. The adapter body is preferably detachably secured to the louver, it being understood that the adapter body could be permanently attached to the louver as by adhesive, sonic welding or the like. In the preferred embodiment illustrated, the adapter body has a louver engaging wall portion 28 shaped to engage the side of the louver at locations outwardly of the opening 27, and a hanger engaging wall portion 29 spaced from the wall portion 28 and arranged to engage the hook portion 22 on the hanger. Side wall portions 31 and reinforcing webs 32 extend between the wall portions 28 and 29.

The wall portion 28 is shaped to conform with the contour of the louver and means are provided for holding the louver in engagement with the wall 28. This means conveniently comprises a stem 33 formed integrally with the wall 28 and arranged to extend through the opening 27 in the louver, and a head 34 on the stem arranged to engage the side of the louver opposite the wall 28. As shown in FIGS. 4 and 5, the head 34 has an oblong configuration and is of a size to pass through opening 27 and the head is arranged so that it extends crosswise of the opening 27, when the louver is disposed generally vertically. Thus, the adapter body can be assembled on the louver by first turning it to a position at right angles to the position shown in FIG. 4 to pass the head 34 through the opening 27, and then turning the adapter body about the axis of the stem 33 to the position shown in FIG. 4. With this arrangement, the adapter body will move substantially in unison with the louver, but the louver can pivot through a small angle about the axis of the stem 33. Protrusions 35 are provided on the outer face of the wall 28 at locations to extend into the opening 27 and limit the amount of angular swinging of the louver about the axis of a stem 33.

The hanger engaging wall 29 of the adapter body has a notch extending upwardly from the lower end and defining vertical edges 29*a* and a horizontal edge 29*b*. The vertical edges 29*a* are spaced apart a distance sufficient to receive the depending leg 23 of the hanger and the horizontal edge 29*b* is arranged to engage the hook portion 22 on the hanger, as best shown in FIG. 2. As will be seen from FIG. 2, the edge 29*b* is on substantially the same plane as the axis of stem 34. Thus, the adapter body suspends the louver from the hanger substantially at the center of gravity of the louver cross-sectional contour, and the louver will depend vertically.

The cross-sectional contour of the louver shown in FIG. 3 has an axis of symmetry AS, and the center of gravity CG is located on the axis of symmetry and is spaced a preset distance from the surface of the louver. The invention can also be applied to louvers having other cross-sectional configurations in which the center of gravity of the cross-sectional contour is spaced from one side of the louver. The location of the center of gravity of the cross-sectional contour can be determined in various ways. However, it can conveniently be determined experimentally by suspending a selected length of the louver from its upper end and then measuring the deviation of the lower end of the louver from a point vertically below the point of suspension. The center of gravity of the cross-sectional louver contour is one-half the amount of horizontal deviation of the lower end of the louver from a point vertically below the point of suspension.

The embodiments of the invention in which an exclusive property or privilege is claimed are defined as follows:

1. A vertical louver system comprising: a track having a plurality of louver carriers mounted for movement therealong and louver hangers mounted on the carriers for turning about a generally upright axis, a plurality of elongate louvers each having a non-linear cross-sectional contour such that the center of gravity of the louver cross-sectional contour is at a CG point spaced from one side of the louver, an adapter body attached to each louver adjacent an upper end thereof and having hanger engaging means adjacent said CG point of the associated louver for suspending the louver from the hanger substantially at the center of gravity of the louver cross-sectional contour.

2. A vertical louver system according to claim 1 wherein the adapter body is detachably mounted on the louver at said one side thereof.

3. A vertical louver system according to claim 1 wherein the adapter body has first wall means engageable with said side of the louver at the location of attachment thereto and means for holding the louver in engagement with said first wall means.

4. A vertical louver system according to claim 1 wherein said louver has an opening adjacent the upper end and substantially medially between side edges of the louver, the adapter body having a stem extending through said opening and wall means engageable with said one surface of the louver at locations outwardly of said opening, and head means on the stem for holding the louver in engagement with said wall means.

5. A vertical louver system according to claim 4 wherein said opening in the louver has a non-circular configuration, said head means having a non-circular configuration movable through the opening.

6. A vertical louver system according to claim 1 wherein the hangers have an upwardly opening hook portion, the hanger engaging means on the adapter body including wall means spaced from said one side of the louver and engageable with said hook portion.

7. A vertical louver system according to claim 1 wherein the louver cross-sectional contour has an axis of symmetry and said center of gravity is on the axis of symmetry and spaced a preset distance from said one side of the louver.

8. A vertical louver system according to claim 7 wherein said adapter body has a louver engaging wall portion engaging said one side of the louver and a hanger engaging wall portion extending crosswise of the axis of symmetry substantially at said CG point.

9. A vertical louver system comprising a track having a plurality of louver carriers mounted for movement therealong and louver hangers mounted on the carriers for turning about a generally upright axis, each hanger having an upwardly opening hook portion, a plurality of elongate louvers each having a non-linear cross-sectional contour such that the center of gravity of the louver cross-sectional contour is at a CG point spaced a preset distance from the side of the louver, a rigid adapter body individual to each louver having a louver engaging wall portion engageable with said one side of the louver and means for holding a louvre in engagement with the louver engaging wall portion, each adapter body having a portion adjacent said CG point of the associated louver engageable with the hook portion of a hanger for suspending the louver from the hanger substantially at the center of gravity of the louver cross-sectional contour.

* * * * *